US007143903B2

(12) United States Patent
Musaragno

(10) Patent No.: US 7,143,903 B2
(45) Date of Patent: Dec. 5, 2006

(54) STOPPER FOR BOTTLING WINES

(76) Inventor: Marco Musaragno, Via Padre Bernardino Da PGO, 6-30026 Portogruaro (VE) (IT)

( * ) Notice: Subject to any disclaimer, the term of this patent is extended or adjusted under 35 U.S.C. 154(b) by 189 days.

(21) Appl. No.: 10/648,803

(22) Filed: Aug. 27, 2003

(65) Prior Publication Data

US 2004/0074862 A1 Apr. 22, 2004

Related U.S. Application Data

(63) Continuation-in-part of application No. PCT/IB01/12215, filed on Nov. 22, 2001.

(30) Foreign Application Priority Data

Aug. 30, 2001 (IT) ..... VI2001A0180

(51) Int. Cl.
*B65D 51/16* (2006.01)
*B65D 39/00* (2006.01)

(52) U.S. Cl. ..... 215/261; 215/364; 215/307; 220/371

(58) Field of Classification Search ..... 215/261, 215/308, 364, 307, 310, 355; 220/261, 308, 220/364, 371, 372, 367.1
See application file for complete search history.

(56) References Cited

U.S. PATENT DOCUMENTS

| | | | | |
|---|---|---|---|---|
| 2,424,930 | A * | 7/1947 | Jackson | 215/314 |
| 2,428,114 | A * | 9/1947 | Hall | 215/260 |
| 3,951,293 | A * | 4/1976 | Schulz | 215/261 |
| 3,952,902 | A * | 4/1976 | Prouty et al. | 215/306 |
| 4,237,526 | A * | 12/1980 | Wood | 362/158 |
| 4,271,973 | A * | 6/1981 | Quagliaro et al. | 215/308 |
| 4,637,919 | A * | 1/1987 | Ryder et al. | 422/300 |
| 4,750,610 | A * | 6/1988 | Ryder | 206/5.1 |
| 5,143,763 | A * | 9/1992 | Yamada et al. | 428/36.2 |
| 5,215,312 | A * | 6/1993 | Knappe et al. | 277/312 |
| 5,522,769 | A * | 6/1996 | DeGuiseppi | 454/270 |
| 5,556,591 | A | 9/1996 | Jallerat et al. | 264/516 |
| 5,732,837 | A * | 3/1998 | Jones | 215/311 |
| 5,855,287 | A * | 1/1999 | Burns | 215/200 |
| 5,882,454 | A * | 3/1999 | Baginski et al. | 156/73.5 |
| 5,901,867 | A * | 5/1999 | Mattson | 215/261 |
| 5,904,965 | A * | 5/1999 | Noel et al. | 428/36.5 |
| 5,988,426 | A * | 11/1999 | Stern | 220/371 |
| 6,193,088 | B1 * | 2/2001 | Vincent et al. | 215/261 |
| 6,196,409 | B1 * | 3/2001 | Lake et al. | 220/371 |
| 6,543,207 | B1 * | 4/2003 | Mainquist et al. | 53/447 |

FOREIGN PATENT DOCUMENTS

| | | |
|---|---|---|
| EP | 0 629 559 | 6/1994 |
| FR | 2 627 467 | 8/1989 |

OTHER PUBLICATIONS

Englsh translation of EP 629 559.*

* cited by examiner

*Primary Examiner*—Nathan J. Newhouse
*Assistant Examiner*—James Smalley
(74) *Attorney, Agent, or Firm*—Dykema Gossett PLLC

(57) ABSTRACT

A stopper for closing wine bottles. The stopper has a tubular duct to communicate residual interior gaseous atmospheric volume with the outer ambient. A membrane is secured transversely in the duct to allow the passage of gaseous atmosphere through the membrane and to selectively block the passage of liquid therethrough.

16 Claims, 1 Drawing Sheet

STOPPER FOR BOTTLING WINES

CROSS REFERENCE TO RELATED APPLICATION

This application is a continuation in part of PCT/IB01/12215 filed Nov. 22, 2001, the teachings of which are incorporated herein by reference.

BACKGROUND OF INVENTION

The present invention relates to a stopper to close bottles which is particularly adapted to store and age vintage wines and is made of synthetic material.

It is well known that wine bottling, more particularly of expensive and consequently valuable wines involves use of glass bottles and corks.

Corks are specially used to store and age vintage wines because cork allows a limited exchange of oxygen between the bottle interior and the ambient and viceversa. This is the essential condition in order that wine can mature and get refined without deterioration of the wine.

Not all corks can be used to bottle vintage wines and this depends both on quality of cork and the cork production system. Indeed corks made for instance with cork granules joined by an adhesive are not adapted to warrant the correct permeability allowing passage of the required but minimal quantity of oxygen to age and refine wine.

Another drawback of the corks is the possibility that the cork may keep even after manufacture mould or residues giving a sharp and intense taste to wine, called cork taste.

Another drawback of the cork consists in that when bottling the cork should have an average moisture not less than 5% and no more than 8%, because a low moisture lower than 5% would cause a too high exchange of oxygen with the ambient while a too high moisture could develop mould.

If on one hand vintage wines need corks of high quality for their storage and ageing, on the other hand the world production of cork more particularly of high quality, is insufficient to meet the demand of the market of vintage wines.

For this reason in the recent times stoppers made of synthetic material were developed, for instance, of polyethylene resins added with a suitable expansion agent, which on one hand can be used to store vintage wines for short periods of time, but on the other hand they are not suitable for their ageing.

Indeed the stoppers made of synthetic materials allow storage of wine unimpaired relative to the bottling time: wine keeps well its liveliness and freshness without alteration with time, but cannot certainly age because permeability of the synthetic material constituting the stopper reduces the permeability index from 80 to 1000 times in comparison with cork.

The stopper of synthetic material has however several advantages such as to be mould-proof and bacteria-proof, making the bottled wine exempt from cork taste.

Another advantage of the synthetic stopper is constancy of quality of said stopper, durability, flexibility and impermeability to liquids.

One of the limitations of the synthetic stopper is not to allow a correct exchange of oxygen with the ambient in view of its substantial impermeability.

To this purpose it is to be noted that another limitation of the synthetic stopper consists in that it resists hardly the big temperature difference which a bottle of wine may undergo for instance when left temporarily in the sun, because increase of volume of wine inside the bottle and the substantial impermeability of the synthetic stopper does not allow leakage of an amount of air comprised between the wine level and the bottom portion of the stopper. Consequently phenomena of stopper removal from its seat and movements of the stopper upwards or even ejection from the bottle were observed.

FR-A-2627467 discloses a flotting cover in a vat of liquid provided with a stopper having a tubular duct having a membrane arranged transversally at the end of said duct. Said membrane allows the passage of the entrapped gasses to escape from the interior of the vat to the outer ambient.

The object of the invention is to provide a stopper of synthetic material overcoming the above mentioned drawbacks.

SUMMARY OF THE INVENTION

A first object of the invention is to provide a stopper of synthetic material having a certain degree of permeability so as to exchange oxygen with the ambient and allow wine contained in the bottle using said stopper to be aged and get refined.

Another object of the invention is to meter the exchange of oxygen through the stopper with the maximum possible precision so that a certain ageing degree of each kind of wine can be warranted thus reaching the required maximum wine quality. The object is generally to obtain a stopper of synthetic material adapted to meet every requirement according to type of wine and ageing degree.

The above mentioned objects and others that will be apparent in the following description are attained by a stopper to close bottles, more particularly wine bottles, that according to the main claim is at least partially made of synthetic material and has a generally cylindrical length to be inserted into the bottle neck, said stopper being characterised by having at least a tubular duct adopted to put the residual volume of air inside the bottle in communication with the external ambient through at least a membrane provided with microholes and arranged transversally in said tubular duct allowing the passage of oxygen from the bottle interior to the outer ambient and viceversa.

It is clear that the present of at least a membrane inside a tubular duct belonging to the stopper, putting the outer ambient in communication with the bottle interior, allows a controlled exchange of oxygen depending on quality of membrane or diameter of its microholes and number of holes per surface unit.

Advantageously according to the invention the at least one membrane of the stopper is impermeable to liquid passage, while it is permeable to gases and therefore to oxygen in both directions, in other words a two way permeability.

BRIEF DESCRIPTION OF THE DRAWINGS

Further characteristics and features of the invention will be better understood by reading the description of preferred embodiments of the invention given as illustrative but non limiting examples and shown in the accompanying drawing in which.

DESCRIPTION OF THE INVENTION

Figure 1:
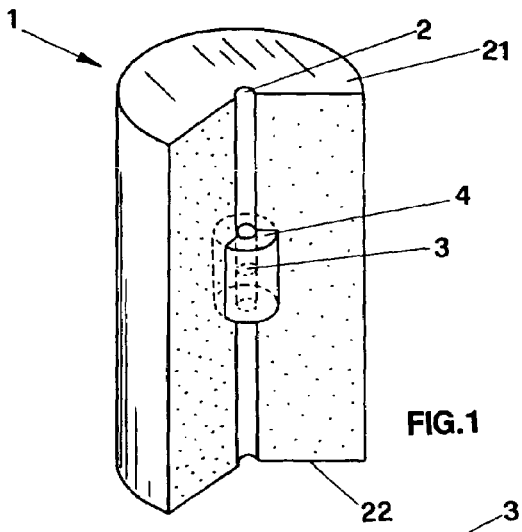
FIG. 1 is a perspective and partially sectional view of a stopper of the invention.
Figure 2:
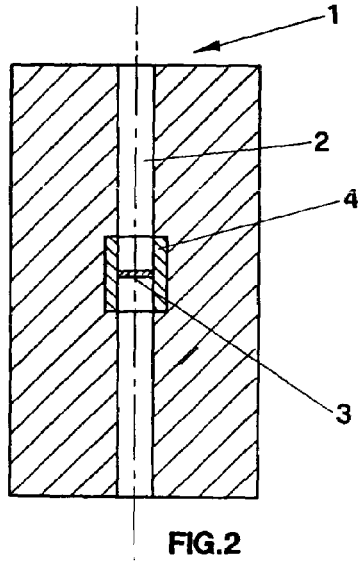
FIG. 2 is a sectional view of the stopper of FIG. 1.

With reference now to the drawing one can see that the stopper generally indicated with reference numeral 1 and shown in FIG. 1 and in the sectional view of FIG. 2, is made of synthetic material that in this embodiment is a polyethylene resin added with an expansion agent so as to obtain the characteristics of lightness typical of cork.

Figure 1A:
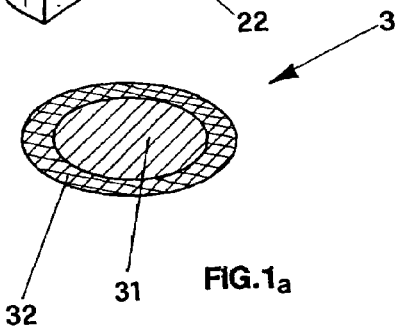
FIG. 1*a* shows a detail of the membrane of FIG. 1.
Figure 1B:
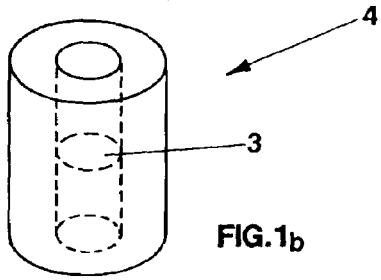
FIG. 1*b* shows the membrane support tube of the stopper of the invention.

The stopper 1 has a tubular duct indicated with numeral 2 which is arranged in this embodiment along the central axis of the stopper. Approximately at the centre line of said tubular duct there is a membrane 3 of hydrophobic type adapted to allow passage of gases only in both directions. In this embodiment the membrane shown also in FIG. 1*a* is made of a film of acrylic copolymer 31 anchored to a support that in this embodiment is made of non woven fabric 32. Said support is included in a tube 4 that can be seen also in FIG. 1*b*, which is inserted in the mould before injection of the acrylic copolymer. It is clear that through the tubular duct 2 extending from the outer surface 21 of the stopper emerging from the bottle to the surface 22 inside the bottle, oxygen may pass proportionally to the size of the microholes of the membrane and the amount of holes involved in the gaseous exchange.

Therefore it is clear that according to the number of holes and their size, as well as the size of the tubular hole, a controlled exchange of oxygen between inside and outside the bottle can be obtained through the stopper 1. Consequently this allows a controlled and homogeneous ageing degree of wine contained in the bottle. Consequently all the bottles of the same lot of wine can have the same exchange of oxygen and therefore the same maturation.

Effected tests showed that the exchange of oxygen between bottle and ambient should be about 0.1 mg of oxygen per year to obtain a good wine ageing.

Consequently according to the type of wine to be treated and results to be obtained, a particular type of membrane or one or more membranes of equal or different type may be chosen.

Good results were obtained with membranes having diameters or holes varying from 0.01 to 0.5 microns according to the kind of wine treated.

More particularly, test were carried out with three types of membranes manufactured by the Italian company GVS SpA.

Each membrane was inserted into a polyester tube and fixed approximately at its center in the horizontal transverse direction as shown in FIG. 2.

Three types of membranes manufactured by the company GVS were tested.

All the membranes were of the hydrophobic kind, i.e. liquid repellant, but adapted to let air and therefore oxygen as well pass in both directions.

The membrane characteristics were the following:

| | Membrane | | |
|---|---|---|---|
| | 1<br>GVS UF 10 | 2<br>GVS UF 100 | 3<br>GVS RO 21 |
| Type | Hydrophobic | Hydrophobic | Hydrophilic |
| Configuration | Flat and supported | Flat and supported | Flat and supported |
| Supporting material | Polyester | Polyester | Polyester |
| Membrane material | Fluorinated polymer | Fluorinated polymer | Polyamide |
| Nominal pore size | <0.01 micron<br>Cut-off = 10 kDlton[1] | <0.01 micron<br>Cut-off = 100 kDlton[1] | Dense membrane<br>NaCl rejection > 99%[2] |
| Thickness | 100–150 micron | 100–150 micron | 100–150 micron |

Said tests were carried out by the University of Udine, Italy on membranes of the above mentioned type, consisting of a circular disc with a 5 mm diameter.

It was found that time required to obtain an exchange of 2 mg oxygen was as follows:

| 1<br>GVS UF 10 | 2<br>GVS UF 100 | 3<br>GVS RO 21 |
|---|---|---|
| 7 days | 15 days | 34 days |

Obviously with smaller membrane diameters, the amount of oxygen decreases considerably.

It is deemed that an ideal membrane diameter, and consequently of the hole 2 made in the stretch 1 of FIG. 1, may be of about 1–1.2 mm.

With such a hole and the membranes used for said tests, good and sufficient levels of exchange of oxygen between bottle interior and outside ambient were obtained, said levels being comparable with those of a cork of the best quality. It was noted that a membrane type GVS RO21 may be suitable to keep and age white wines, while a membrane type GVS UF 100 may be suitable to keep and age red wines.

Figure 3:
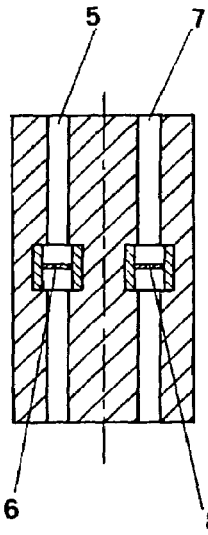
FIG. 3 shows another embodiment of the stopper of FIG. 1.

In FIG. 3 a first modified version of the invention is shown in which there are two tubular ducts and one membrane for each duct. Indeed the tubular duct 5 has the membrane 6 and the tubular duct 7 has inside the membrane 8.

The stopper of FIG. 3 the membrane conditions relative to the stopper of FIGS. 1 and 2 being equal, allows a double exchange of oxygen between bottle inside and ambient.

Figure 4:
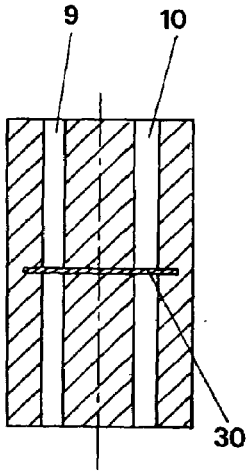
FIG. 4 shows another embodiment of the stopper of the invention.

In FIG. 4 another modified version of the invention is shown in which one can see one membrane only indicated with numeral 30 exchanging oxygen between ambient and bottle through two ducts indicated with numerals 9 and 10. Clearly the portion of the membrane that does not match the tubular ducts is generally inoperative.

Figure 5:
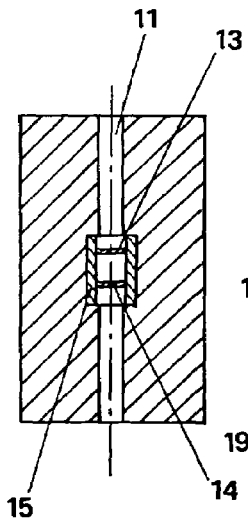
FIG. 5 is a sectional view of a further embodiment of the invention.

FIG. 5 shows another modified version of the invention in which there is only one tubular duct 11 where inside said duct there are two membranes indicated with numerals 13 and 14 and arranged inside the same tube 15.

Figure 6:
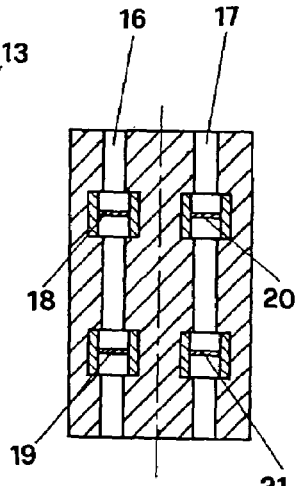
FIG. 6 is another sectional view of another modification of the invention.

Another modified version of the invention is shown in the cross sectional view of the stopper of FIG. 6. In this case the stopper has two tubular ducts 16 and 17 inside each of them two membranes 18 and 19 being arranged for the duct 16 and two membranes 23 and 24 for the duct 17.

It is known that exchange of oxygen between bottle inside and outer ambient and viceversa occurs particularly with change of temperature of wine which consequently undergoes a volume change. When volume inside the wine bottle increases, there is ejection of oxygen contained inside the bottle, while when wine volume tends to return to the starting volume in view of a temperature reduction, there is introduction of oxygen from outside.

These movements and exchanges of oxygen as it is well known in the wine field, cause refinement and improvement of wine as well as its preservation that varies from one kind of wine to the other.

From the foregoing one can see that the invention attains the object to provide a stopper that being made of synthetic material thus having all the advantages of a stopper of synthetic material, at the same time allows also a controlled exchange of oxygen, thus allowing to use said stoppers for bottling vintage wine.

The invention claimed is:

1. A stopper for closing bottles at least partially made of synthetic material and having a generally cylindrical shape and selected diameter, and having end portions for insertion into the bottle neck, the stopper being formed with a tubular duct extending between the end portions and being adapted to put the residual volume of air present inside the bottle in communication with the outer ambient;

a separate tube located in the tubular duct, and a membrane having a diameter and a thickness, and being provided with microholes, said membrane being located in the tube and arranged transversely thereof for allowing the passage of oxygen through the membrane from the bottle interior to the outer ambient and vice-versa, and wherein the diameter of the membrane is greater than the thickness thereof and less than the diameter of the stopper.

2. The stopper according to claim 1 wherein the size of the diameter of said microholes is such as to avoid the passage of liquids.

3. The stopper according to claim 1, wherein said microholes of said membrane have a diameter between about 0.01 and about 0.5 microns.

4. The stopper according to claim 1, wherein said membrane is made of a film of acrylic copolymer anchored to a support of non woven fabric.

5. The stopper according to claim 1, wherein the membrane is made with a film of fluorinated polymer.

6. The stopper according to claim 1, wherein the membrane is made with a polyamide film.

7. The stopper according to claim 1, wherein the synthetic material by which said stopper is made belongs to the group of polyethylene resins added with an expansion agent.

8. The stopper according to claim 1, wherein the stopper is formed of a polyethylene resin and an expansion agent.

9. A stopper having a selected diameter for insertion into the neck of a liquid containing bottle having a residual volume of gaseous atmosphere in the interior of the bottle above the liquid comprising:

a body having opposite ends and a generally cylindrical shape, and a tubular through duct extending between the ends;

a separate tube located in the duct; and a membrane having a thickness and a diameter, the diameter of the membrane being greater than said thickness and less than the diameter of the stopper, said membrane being secured transversely across the tube for allowing communication between the interior and exterior of the bottle, said membrane having microholes therethrough for allowing the passage of gaseous atmosphere from the interior of the bottle to the exterior of the bottle, and to selectively block the passage of liquid therethrough.

10. The stopper according to 9, where in the body is formed of a synthetic material comprising at least one of a support of a non woven fabric and; polyethylene resin mixed with an expansion agent; and the membrane comprises a film anchored to the support including at least one of an acrylic co-polymer, a polyamide film; and a fluorinated polymer.

11. A stopper for closing bottles comprising:

a cylindrical body having a selected diameter and a tubular duct therethorugh, a separate tube in the tubular duct and a membrane having a diameter and thickness, and being formed with microholes, said membrane being arranged transversely to and fixed within said tube, said holes being sized for selectively allowing the passage of oxygen while inhibiting passage of liquid therethrough, and the diameter of the membrane being greater than the thickness thereof and less than the diameter of the body.

12. The stopper according to claim 11, wherein said microholes have a diameter between about 0.01 and about 0.5 microns.

13. The stopper according to claim 11, wherein said membrane is formed of at least one of a film of acrylic copolymer; a film of fluorinated polymer; a polyamide film.

14. The stopper according to claim 11, wherein the membrane includes a peripheral support of non-woven fabric.

15. A stopper for wine bottles comprising:

a cyindrical body having a selected diameter and being formed of a polymeric material having end portions and a cylindrical duct extending from the end portions axially of the body along a central axis thereof;

a separate tube located within the body between the end portions having a central opening aligned and in communication with the duct;

a membrane having a diameter and thickness, and being formed with microholes of a selected dimension, said membrane being located within the tube transversely to said tubular duct for allowing passage of oxygen between the bottle interior and ambient in amounts compatible with the contents of the wine bottle, and wherein the diameter of the membrane is greater than the thickness thereof and less than the diameter of the body.

16. A stopper for closing wine bottles, comprising:

a body formed of synthetic material having a generally cylindrical shape and ends, the body being formed with a tubular duct having a diameter and extending between ends of the body along a central axis of the body;

a tube located in the tubular duct having a cylindrical opening aligned with the axis of the body and a diameter corresponding to the diameter of the duct; the tube having an outer diameter larger than the diameter of the duct; and a membrane having microholes, said membrane being located in the tube and disposed transversely thereof for allowing the passage of gas between the interior of the bottle interior and ambient.

* * * * *